US005724956A

United States Patent [19]

Ketterhagen

[11] Patent Number: 5,724,956

[45] Date of Patent: Mar. 10, 1998

[54] RIDING SAW FOR CUTTING CONCRETE AND SIMILAR MATERIALS

[75] Inventor: Frederick A. Ketterhagen, Burlington, Wis.

[73] Assignee: Diamond Products Joint Venture, Elyria, Ohio

[21] Appl. No.: 611,545

[22] Filed: Mar. 6, 1996

[51] Int. Cl.[6] ..... B24D 1/04

[52] U.S. Cl. ..... 125/13.01; 125/13.03; 125/12; 125/14; 451/352; 180/213

[58] Field of Search ..... 125/13.01, 13.03, 125/14, 12; 451/352; 299/58, 59; 180/211, 213, 214

[56] References Cited

U.S. PATENT DOCUMENTS

| | | | |
|---|---|---|---|
| 2,569,682 | 10/1951 | Lewis | 262/20 |
| 2,673,725 | 3/1954 | Coates | 262/20 |
| 2,858,650 | 11/1958 | Janowitz | 51/176 |
| 2,973,950 | 3/1961 | Tucker | 262/20 |
| 3,043,200 | 7/1962 | Huttash | 451/352 |
| 3,141,702 | 7/1964 | Barton | 299/39 |
| 3,617,091 | 11/1971 | Mooney | 299/39 |
| 3,785,705 | 1/1974 | Binger et al. | 299/75 |
| 3,901,553 | 8/1975 | Binger et al. | 299/39 |
| 4,094,102 | 6/1978 | Lauze et al. | 125/13.03 |
| 4,361,203 | 11/1982 | Buschbom | 180/213 |
| 4,709,736 | 12/1987 | Bellars | 144/2 N |
| 4,748,966 | 6/1988 | Kennedy | 125/14 |
| 4,778,304 | 10/1988 | Baldi et al. | 404/87 |
| 4,832,412 | 5/1989 | Bertrand | 299/39 |
| 4,840,431 | 6/1989 | Jedick | 299/39 |
| 5,092,658 | 3/1992 | Smith | 451/352 |
| 5,176,426 | 1/1993 | Adamson | 125/14 |
| 5,215,071 | 6/1993 | Mertes et al. | 125/13.01 |
| 5,354,147 | 10/1994 | Swisher, Jr. | 404/90 |

OTHER PUBLICATIONS

Magnum Diamond & Machinery, Inc. promotional brochure entitled "RPS 6590/UC" copyright 1989.

*Primary Examiner*—Robert A. Rose
*Assistant Examiner*—George Nguyen
*Attorney, Agent, or Firm*—Rankin, Hill, Porter & Clark

[57] ABSTRACT

The present invention provides a new and improved rideable power saw for cutting concrete, asphalt, rock and the like. The saw includes a seat for supporting the rider and a mechanical steering assembly for manipulating the position of a rear drive wheel which is powered by a hydraulic motor. The saw also includes a blade drive mechanism for supporting and rotating the rotary saw blade. The saw blade is powered for rotation by a hydraulic motor and the blade drive mechanism includes a hydraulic cylinder for raising and lowering the position of the cutting blade without altering the position of the main platform of the saw.

11 Claims, 6 Drawing Sheets

RIDING SAW FOR CUTTING CONCRETE AND SIMILAR MATERIALS

FIELD OF THE INVENTION

The present invention concerns a circular or rotary power saw device for cutting concrete, asphalt, rock and similar materials. More particularly, the present invention concerns a concrete rotary power saw that also serves as a vehicle for the operator.

BACKGROUND OF THE INVENTION

The prior art provides various motor driven or powered saws for cutting grooves into materials such as concrete pavement and the like. Grooves are commonly cut in concrete and related materials either to facilitate the removal of such materials or to control the cracking of such materials. More particularly, in areas having wide seasonal temperature variation, concrete floors, pavement, median strips, curbs and concrete barriers crack due to expansion and contraction. In order to control the location of the cracking, and thus prevent the random spacing and crooked line cracking that leads to an unsightly appearance and weakened portions, grooves are cut in the surface of such objects.

An example of a prior art concrete saw may be found in Jedick U.S. Pat. No. 4,840,431. Like many prior art saws, the Jedick saw provides a power source such as a gas or diesel engine mounted upon a movable carriage and a power transmission device for transferring power from the power source to a rotary saw blade. As with most prior art concrete saws, the saw of Jedick does not serve as a vehicle or means of transportation for the operator of the saw.

The prior art also provides a concrete saw that serves to transport an operator. An example of a prior art concrete saw that also serves to transport the operator may be found in Bertrand U.S. Pat. No. 4,832,412. Bertrand provides a truck-like vehicle having a support base at the back of the vehicle for cutting pavement. The base includes a boom that extends laterally of the vehicle. A rail system and saw carrier is mounted at one end of the boom and the saw carrier is capable of moving along the boom. The Bertrand saw is a large, expensive and complex device that is not generally employed by persons involved in the business of cutting concrete.

SUMMARY OF THE INVENTION

The present invention provides a new and improved rideable concrete saw that provides various distinct advantages over prior art concrete saws. More particularly, the present invention provides a concrete saw for transporting an operator that includes a steering mechanism that provides the operator with complete control over the steering function of the saw, thereby avoiding "under" or "over" steer situations that can lead to a broken cutting blade. Further, the saw of the present invention is capable of powering blades of various diameters, up to 72" in diameter, because it employs a hydraulic raise/lower system that manipulates the position of the blade alone, and not the entire frame of the concrete saw.

In a preferred embodiment the riding saw of the present invention includes a main support frame having mounted thereto a blade drive mechanism for supporting and rotating a rotary cutting blade, and a pair of wheels mounted beneath the support frame at the fore end of the frame. At its aft end, the support frame includes a steerable drive wheel. Extending above the main support frame is a seat for supporting a rider. Also mounted above the support frame is a steering assembly having a steering device located in the proximity of the seat. The steering assembly is mechanically attached via links to the drive wheel thereby allowing a rider to adjust the position of the drive wheel via the manipulation of the steering device.

The blade drive mechanism includes a longitudinal arm having the cutting blade mounted at its distal end. The proximate end of the arm is secured by a pivot joint and the distal end of the arm which includes the blade is raised and lowered via a hydraulic cylinder. Preferably, both the rotary saw blade and the rear drive wheel are powered by a hydraulic motor.

The foregoing and other features of the invention are hereinafter more fully described and particularly pointed out in the claims, the following description and drawings setting forth in detail certain illustrative embodiments of the invention, these being indicative, however, of but a few of the various ways in which the principles of the invention may be employed.

DETAILED DESCRIPTION

Figure 1:
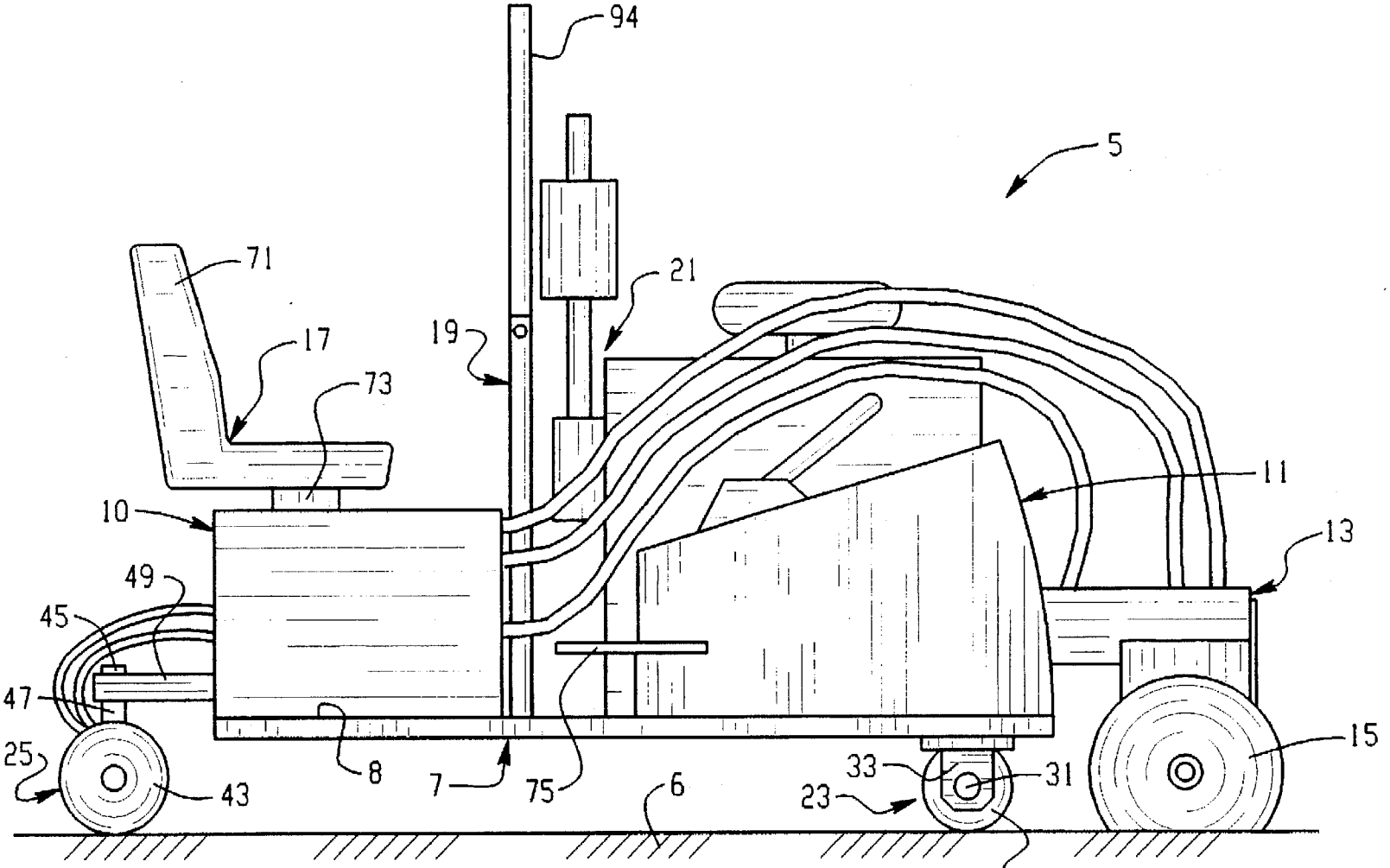
FIG. 1 is a schematic side environmental view of a concrete riding saw made in accordance with the present invention.
Figure 2:
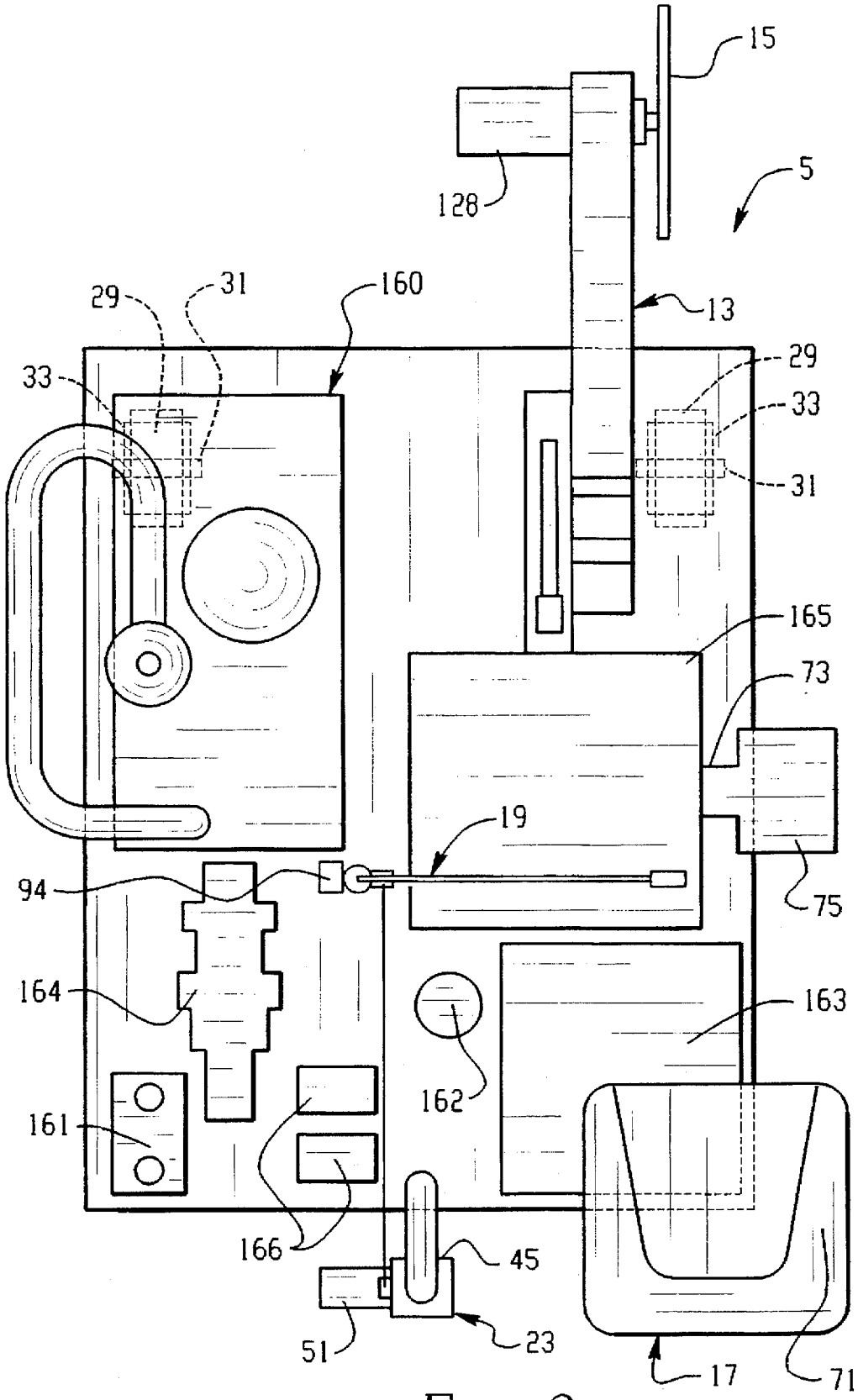
FIG. 2 is a top view of the riding saw of FIG. 1.
Figure 3:
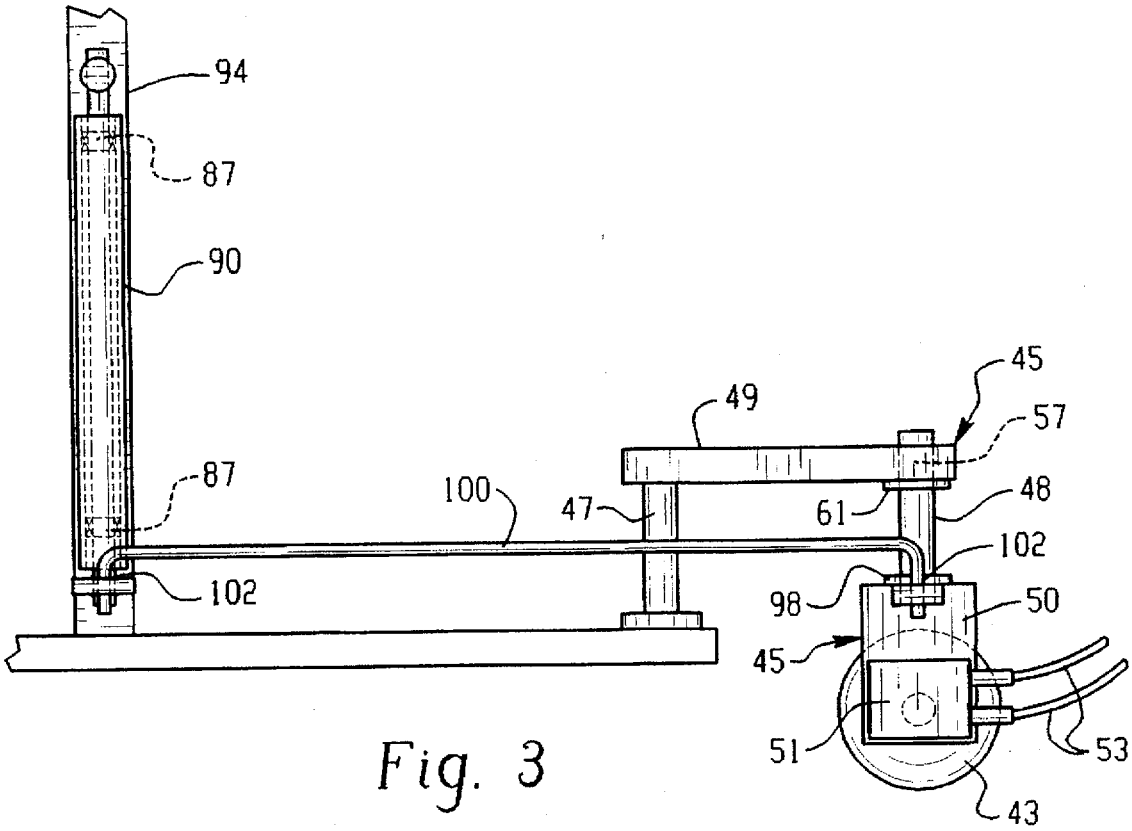
FIG. 3 is a broken-away view of the steering system of the riding saw FIG. 1.
Figure 4:
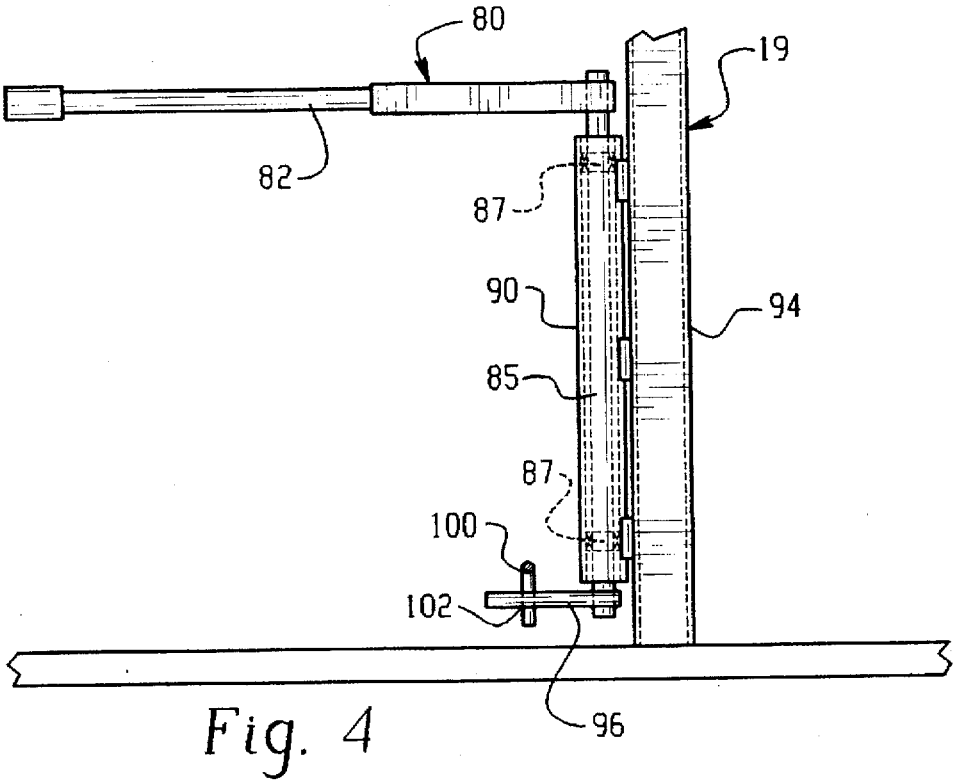
FIG. 4 is a broken-away front view of the steering system of the riding saw of FIG. 1.
Figure 5:
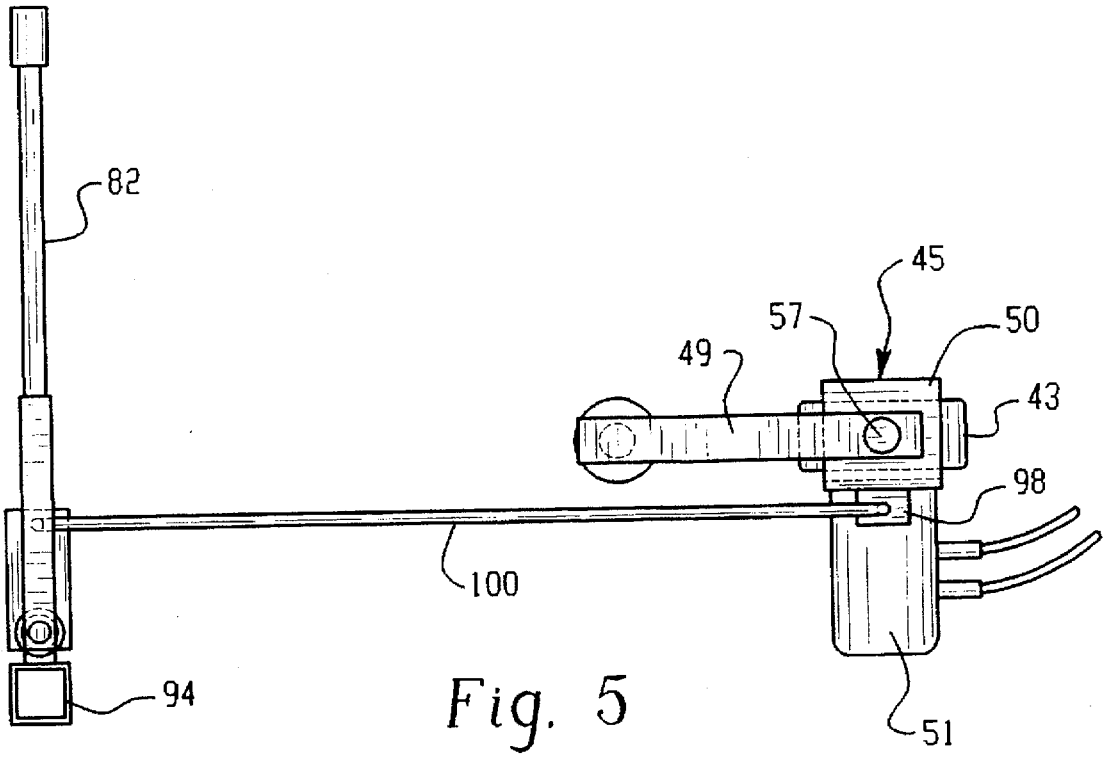
FIG. 5 is a broken-away top view of the steering system of the riding saw of FIG. 1.

Referring to the drawings and initially to FIGS. 1 and 2 there is illustrated a rideable concrete saw 5 made in accordance with the present invention. Concrete saw 5 can be used to cut grooves in a variety of materials including asphalt, rock and similar materials (generally indicated at 6 in FIG. 1). In order to facilitate the illustration of the saw 5, in the figures most of the hydraulic lines and associated fittings are not illustrated.

Concrete saw 5 includes a main support frame 7 to which the various components of the saw are mounted. The main support frame 7 which comprises a horizontally extending metal plate top 8 and a plurality of spaced reinforcement bars (not shown) includes an aft end generally indicated at 10 and a fore end generally indicated at 11. Mounted upon the main support frame 7 is the drive assembly 13 for supporting and powering the rotary saw blade 15, the seat assembly 17 for supporting a rider or operator, the steering assembly 19, and the power source generally indicated at 21 for providing power for the various driven or powered saw functions. Mounted beneath the main support frame 7 is the front wheel assembly 23 and mounted at the aft end 10 of the main support frame 7 is the rear drive wheel assembly 25.

The front wheel assembly 23 includes a pair of rubber-treaded iron wheels 29 mounted on an axle 31. Axle 31 is fixed in position by a pair of conventional bearing blocks 33 which are mounted to the underside of the main support frame 7.

The rear wheel assembly 25 includes a rubber-treaded iron wheel 43 supported for rotation upon support assembly 45. As seen also in FIGS. 3–6, support assembly 45 includes a vertical leg 47, a vertical portion 48 and a horizontal leg 49. Mounted at the base of the vertical portion 48 is a support clevis 50 for the wheel 43 and amounted on clevis 50 is a hydraulic drive motor 51 which is fed with hydraulic fluid via lines 53 for forward and reverse rotation of the wheel 43. Vertical portion 48 includes a vertically extending axle 57 (indicated by hidden lines) which is supported in a conventional bearing assembly 61. Bearing assembly 61 allows the wheel 43 and the drive motor 51 to rotate freely. Drive motor 51 may comprise, for example, a Charlynn Series 2000 hydraulic motor sold by the Eaton Corporation of Cleveland, Ohio.

The seat assembly 17 includes a conventional cushioned seat 71 for supporting an operator which is supported by a plurality of welded bars and supports 73 securely mounted to the main support frame 7. A foot rest 75 is also provided for the operator and it is also securely mounted to the main support frame 7. Located in the proximity of the seat assembly 17 is the steering assembly 19.

Figure 6:
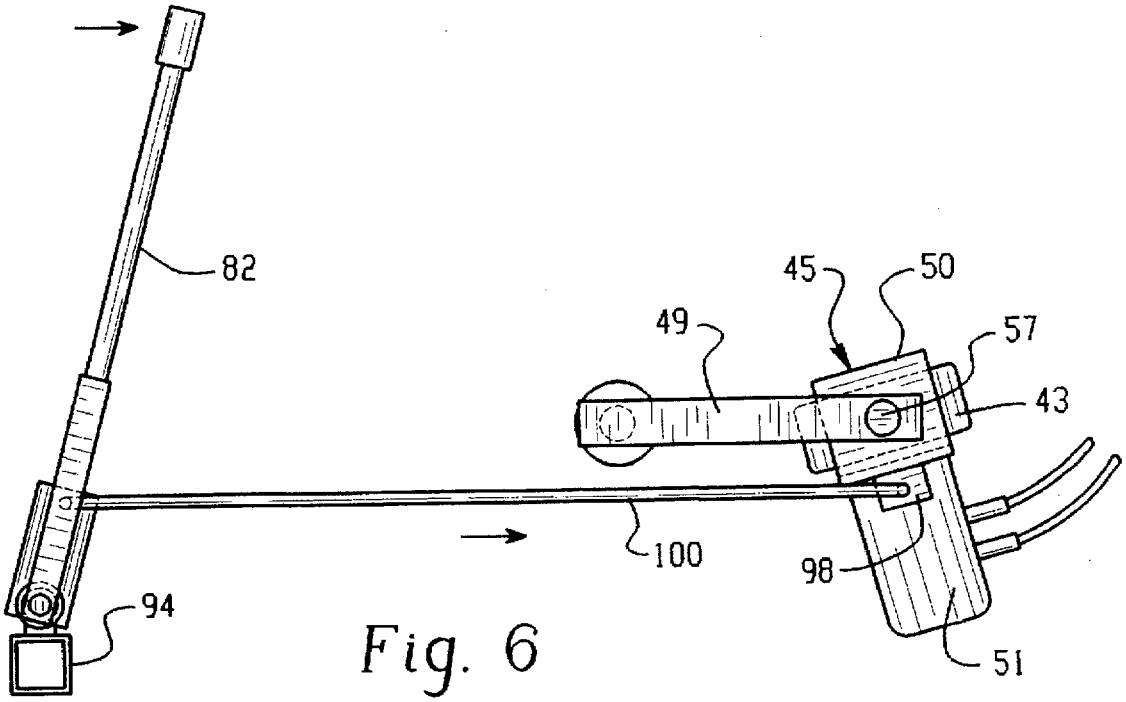
FIG. 6 is another broken-away top view of the steering system of the riding saw of FIG. 1 with the steering lever of the steering system in a modified position.
Figure 7:
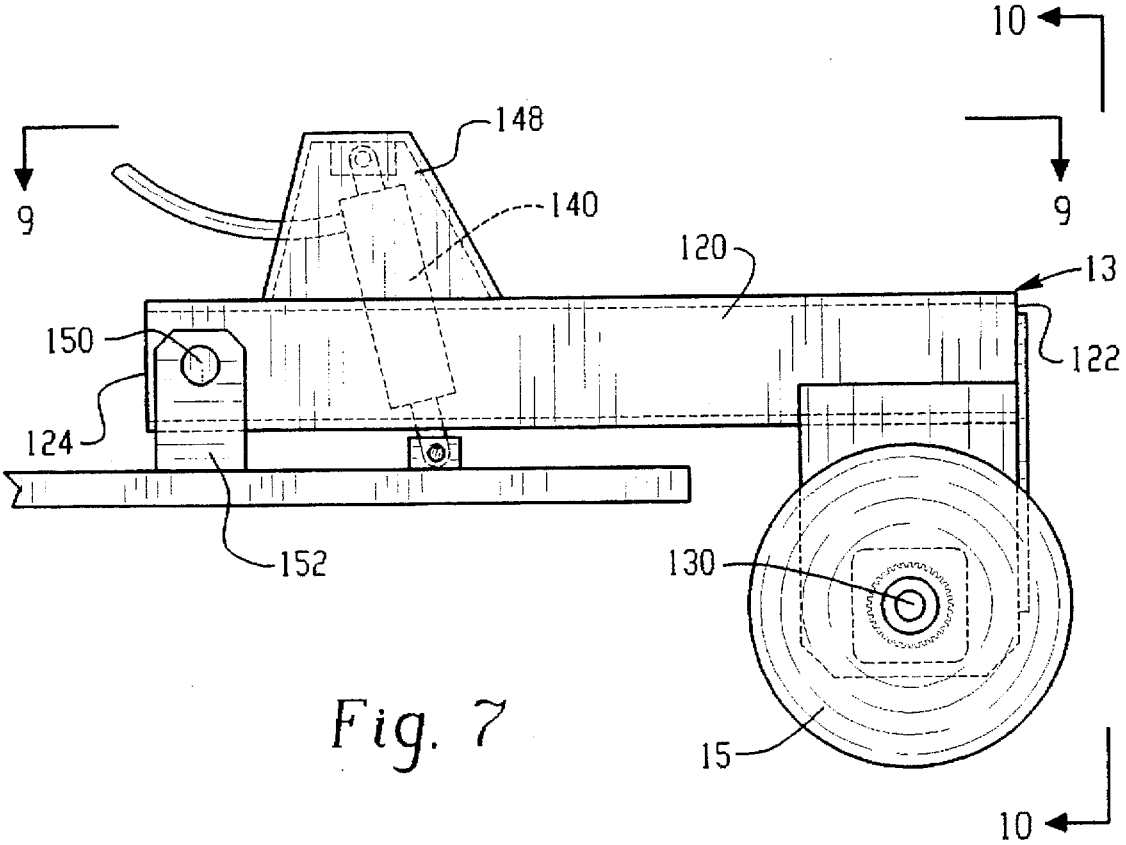
FIG. 7 is a broken-away view of the mechanism for supporting and rotating the rotary cutting blade of the riding saw of FIG. 1.
Figure 8:
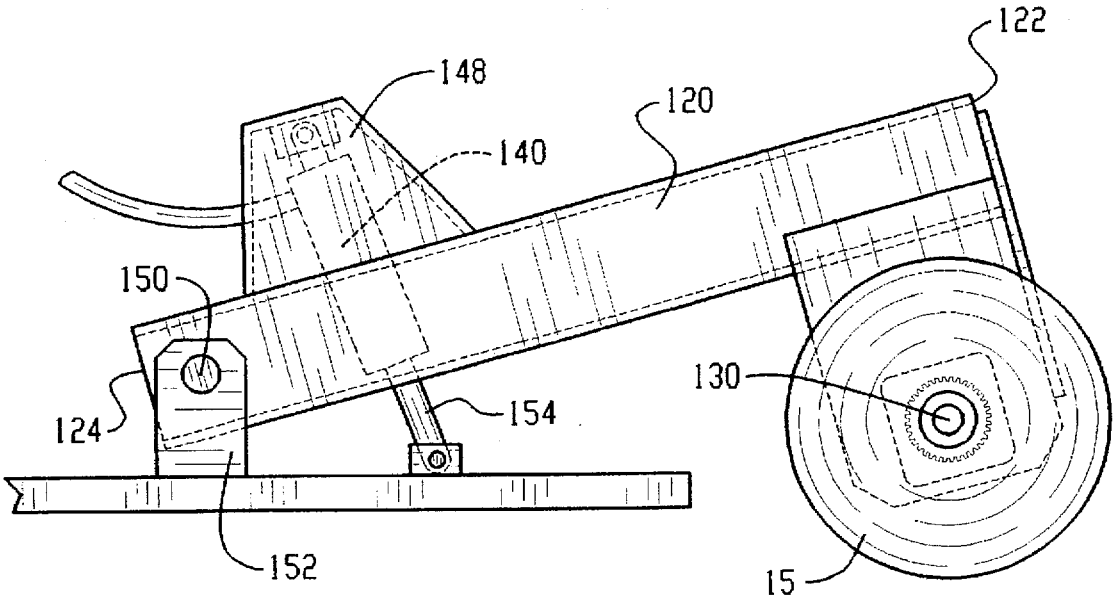
FIG. 8 is a broken-away view of the mechanism for supporting and rotating the rotary cutting blade of the riding saw of FIG. 1 in a modified position from FIG. 7.
Figure 9:
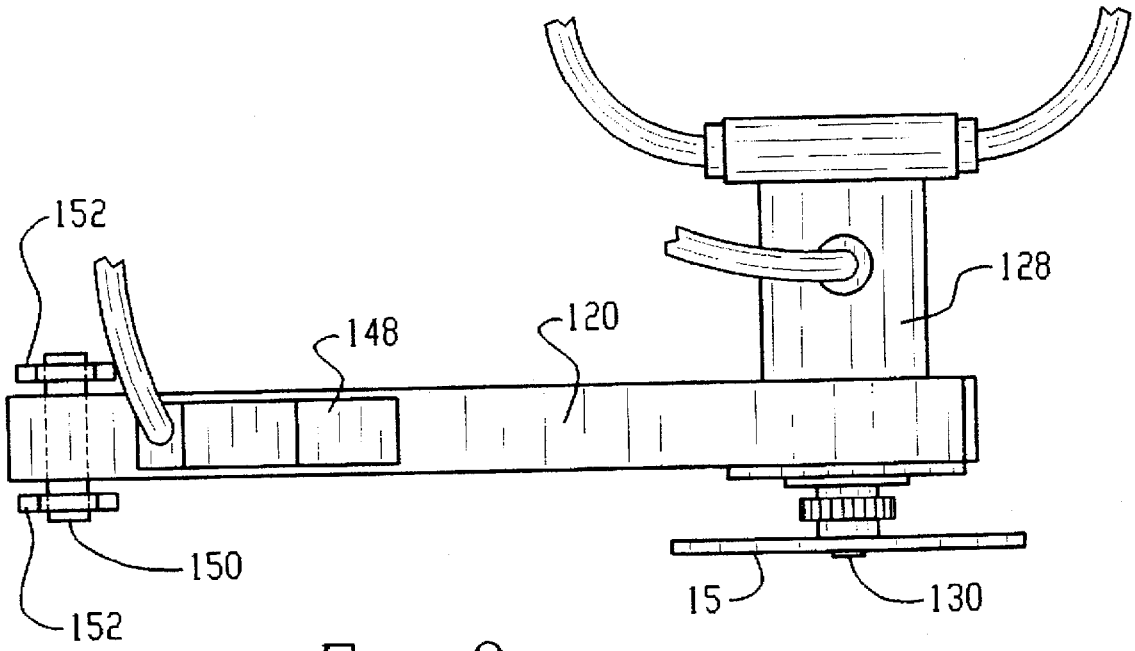
FIG. 9 is a broken-away top view of the mechanism for supporting and rotating a rotary cutting blade viewed from line 9—9 of FIG. 7.
Figure 10:
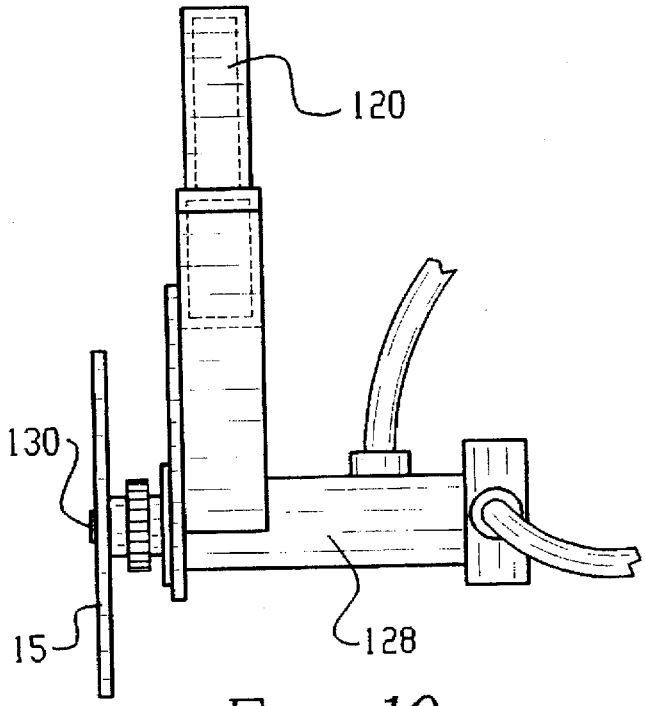
FIG. 10 away front view of the mechanism for supporting and rotating a rotary cutting blade viewed from line 10—10 of FIG. 7.

The steering assembly 19 for altering the position of the rear wheel 43 includes a steering lever 80 having a horizontal leg 82 and a vertical leg 85. The horizontal leg 82 is positioned so that it is located within easy reach of an operator. The vertical leg 85 of the steering assembly 19 is supported for rotation by bearings 87 disposed within tube 90. Tube 90 is welded to a vertical support bar 94 that is securely attached at its base to support frame 7. Mounted at the bottom end of the vertical leg 85 is a horizontal arm 96. Arm 96 is attached to horizontal arm 98 extending from rear wheel assembly 45 by tie rod 100. Tie rod 100 includes conventional swivel joints 102 at each end that allow the ends of the tie rod 100 to swivel relative to the respective arms 96 and 98. Thus, when the operator pulls back on horizontal leg 82 of steering lever 80, the rear wheel 43 rotates in a first direction as shown in FIG. 6, and when the operator pushes on the horizontal leg 82 of steering lever 80 in the opposite direction, the wheel 43 pivots in the opposite direction.

The illustrated manual or unpowered steering configuration has been found to be unexpectedly advantageous. Specifically, this steering configuration provides the operator with a high degree of steering control which avoids "under" and "over" steer conditions. Without a high degree of steering control there is a risk that the position of the saw will deviate from its intended course thereby binding the rotating saw blade, and possibly damaging or breaking such blade. The steering configuration also facilitates double cuts (i.e., multiple cuts made in the same joint). More particularly, with the present steering configuration an operator can easily track or follow an existing groove or cut.

It will be appreciated that steering lever 80 need not be limited to the illustrated horizontal and vertical legs. More particularly, steering lever 80 may also comprise, for example, a steering wheel (either a partial or full wheel).

Referring now to FIGS. 7–10 the drive assembly 13 for supporting and rotating the saw blade 15 is further illustrated. Assembly 13 includes a longitudinal arm 120 having a fore end 122 and an aft end 124. The mechanism for rotating the blade 15 includes a hydraulic motor 128 having a conventional axle assembly 130 to facilitate the mounting and removal of the blade 15. Preferably, hydraulic motor 128 is reversible so as to allow the rotation of blade 15 in a forward or reverse direction. An example of a suitable hydraulic motor that may be used to drive blade 15 is a Model 3331-029 motor sold by Eaton Corporation of Cleveland, Ohio.

The longitudinal arm 120 is raised and lowered using a hydraulic cylinder 140. Hydraulic cylinder 140 is attached at each of its ends in a conventional manner via clevises, trunnions and pins. The upper end of cylinder 140 is preferably protected within housing 148 which is securely attached to longitudinal arm 120. Longitudinal arm 120 is supported for rotation at its aft end 124 by pin 150 and clevises 152. Thus, upon extension of the ram 154 of cylinder 140, the fore end 122 of arm 120, and thus the blade 15, are raised. It will be appreciated that drive assembly 13 can be designed to accommodate blades of various sizes, including blades up to and in excess of 72" in diameter. Further, it will be appreciated that arm 120 and the mounting hardware for hydraulic cylinder 140 may be modified so as to allow an operator to tilt or angle the blade 15.

Hydraulic power for the various functions of the saw is provided by a conventional engine or motor 160 and a conventional hydraulic pump system 164 and filter system 166. Preferably, hydraulic pump system 164 comprises multiple pumps, one pump for the hydraulic motor 128 for blade 15, and one pump for the hydraulic cylinder 140 and the hydraulic motor 51 that drives wheel 43. Preferably, on the return line of the hydraulic pump that powers the motor 128 and blade 15, there is provided a flow control valve that allows for precision speed adjustment of blade 15. In many applications, a preferred engine is, for example, a 65 horsepower diesel motor made by Deutz of Germany. Of course, it will be appreciated that various engines may be employed, such as, for example, a gasoline engine or an electric motor. Conventional controls are provided on the saw for controlling the speed of the engine 160 and the speed and direction of the hydraulic flow used to power hydraulic motors 51 and 128, and cylinder 140.

It will be appreciated that the hydraulic drive system of the present invention affords various distinct advantages over the belt drive systems of the prior art. Specifically, by using a hydraulic drive on the blade the saw can provide a wide range of speed without a corresponding loss in power and there is no requirement to change or modify pulley and belt drives in order to change the blade cutting speed. Further, since no belts and pulleys are employed, the engine 160 may be mounted on platform 7 using conventional rubber isolators without loss in power due to belt slippage. By minimizing the vibration transferred from the engine to the saw blade, the life of the blade can be extended especially when employing a diamond cutting blade. Further, with the hydraulic drive system, the engine can be placed in various orientations upon platform 7. Also, by use of a hydraulic cylinder to raise and lower the blade, instead of raising and lowering the entire platform as is practiced with many prior art saws, the engine maintains a substantially horizontal position thereby avoiding internal oil flow problems that contribute to abnormal engine wear. Further, it will be appreciated that the hydraulic drive system of the riding saw can be used to provide power to remote accessories such as, for example, core bit drills and wire saw assemblies.

While the invention has been shown and described with respect to specific embodiments thereof, this is intended for the purpose of illustration rather than limitation, and other variations and modifications of the specific devices herein shown and described will be apparent to those skilled in the art all within the spirit and scope of the present invention. Accordingly, this patent is not to be limited in scope and effect to the specific embodiments herein shown and described nor in any other way that is inconsistent with the extent to which the progress in the art has been advanced by the invention.

What Is claimed:

1. A riding saw for cutting concrete and similar materials comprising a main support frame having a fore end and an aft end, said main support frame having mounted thereto a blade drive mechanism for supporting and rotating a rotary cutting blade and a pair of front wheels mounted to said main support frame, said support frame having mounted at its aft end a steerable drive wheel powered for rotation by a hydraulic motor, extending above the main support frame is a seat for supporting a rider, and mounted on said main support frame is a steering assembly having a steering device located in the proximity of said seat, said steering assembly being mechanically linked to said drive wheel thereby allowing a rider to adjust the position of said drive wheel via the manipulation of said steering device, wherein said steering assembly includes a support tube extending vertically up from said main support frame and said steering device comprises a vertical portion and a horizontal portion, said vertical portion of said steering device being supported for rotation within said support tube and being attached to said drive wheel by a steering link.

2. A riding saw as set forth in claim 1 wherein said blade drive mechanism comprises a longitudinal arm extending along a portion of the longitudinal length of said main support frame, said longitudinal arm having a proximate end located in the general area of said seat and a distal end located near the fore end of said main support frame, said saw blade being mounted for rotation at said distal end of said longitudinal arm, said proximate end of said longitudinal arm including a pivot joint that allows said distal end of said longitudinal arm to be raised and lowered.

3. A riding saw as set forth in claim 2 wherein said blade drive mechanism includes a hydraulic cylinder for raising and lowering the distal end of said longitudinal arm.

4. A riding saw as set forth in claim 3 wherein said blade drive mechanism includes a hydraulic motor for powering said cutting blade for rotation.

5. A riding saw as set forth in claim 3 including a power source for providing power to said drive wheel and said rotary cutting blade.

6. A riding saw as set forth in claim 5 wherein said power source comprises a motor selected from the group consisting of a diesel engine, a gasoline engine and an electric motor.

7. A riding saw as set forth in claim 5 wherein said power source powers a hydraulic pump system, said hydraulic pump system providing a source of hydraulic power for said hydraulic motor of said drive wheel and said hydraulic cylinder for raising and lowering the distal end of said longitudinal arm.

8. A riding saw as set forth in claim 5 wherein said power source powers a hydraulic pump system, said hydraulic pump system providing a source of hydraulic fluid power for said hydraulic motor for driving said cutting blade.

9. A riding saw as set forth in claim 6 wherein said power source is mounted longitudinally along the longitudinal length of said main support frame.

10. A riding saw as set forth in claim 9 wherein said front wheels are mounted beneath said main support frame.

11. A riding saw as set forth in claim 1 wherein said steering link comprises a tie rod having at each end a swivel joint that allows the ends of the tie rod to swivel.

* * * * *